US006472808B1

(12) United States Patent
Uchida et al.

(10) Patent No.: US 6,472,808 B1
(45) Date of Patent: Oct. 29, 2002

(54) COLOR CATHODE RAY TUBE HAVING ELECTROSTATIC QUADRUPOLE LENSES

(75) Inventors: Go Uchida; Shoji Shirai; Shinichi Kato; Koichi Miyagawa, all of Mobara (JP)

(73) Assignee: Hitach, Ltd., Tokyo (JP)

( * ) Notice: Subject to any disclaimer, the term of this patent is extended or adjusted under 35 U.S.C. 154(b) by 0 days.

(21) Appl. No.: 09/468,861

(22) Filed: Dec. 21, 1999

(30) Foreign Application Priority Data

Dec. 22, 1998 (JP) ..... 10-365446

(51) Int. Cl.[7] ..... H01J 29/58; H01J 29/56

(52) U.S. Cl. ..... 313/414; 313/441; 313/446; 313/421; 315/382

(58) Field of Search ..... 313/414, 417, 313/421, 441, 446–449, 409–412; 315/382, 382.1

(56) References Cited

U.S. PATENT DOCUMENTS 5,739,631 A * 4/1998 Tojyou et al. ..... 313/414
5,744,917 A * 4/1998 Kawaharada ..... 315/382.1
5,814,929 A * 9/1998 Jo ..... 313/414
5,828,191 A * 10/1998 Shirai et al. ..... 315/382
6,031,346 A * 2/2000 Shirai et al. ..... 315/382

FOREIGN PATENT DOCUMENTS

EP 0 652 583 A1 5/1995
EP 0 805 473 A2 11/1997
JP 10-092333 4/1998
JP 2001084920 A * 3/2001 ..... H01J/29/48

* cited by examiner

*Primary Examiner*—Vip Patel
*Assistant Examiner*—Sikha Roy
(74) *Attorney, Agent, or Firm*—Antonelli, Terry, Stout & Kraus, LLP

(57) ABSTRACT

A color cathode ray tube includes third, fourth and fifth electrodes and an anode in its electron beam focusing section. A first-type electrostatic quadrupole lens is formed between first and second members of the fifth electrode for focusing electron beams in one of horizontally and vertically and diffusing the electron beams in the other of horizontally and vertically increasingly with decreasing beam deflection, and a second-type electrostatic quadrupole lens is formed between first and second members of the third electrode for focusing the electron beams in the other of horizontally and vertically and diffusing the electron beams in the one of horizontally and vertically increasingly with the decreasing beam deflection, and an electron lens is formed between the fourth electrode and a first aperture formed in a first surface of the second member of the third electrode adjacent to the fourth electrode, the first surface being on a side of the second member of the third electrode opposite from the fourth electrode, for diffusing the electron beams horizontally and focusing the electron beams vertically increasingly with the decreasing beam deflection.

20 Claims, 15 Drawing Sheets

COLOR CATHODE RAY TUBE HAVING ELECTROSTATIC QUADRUPOLE LENSES

BACKGROUND OF THE INVENTION

The present invention relates to a cathode ray tube, and in particular to a color cathode ray tube having an electron gun employing a multistage focus lens for focusing a plurality of electron beams on a phosphor screen.

Shadow mask type color cathode ray tubes are prevailingly used as TV picture tubes and monitor tubes for information terminals. The shadow mask type color cathode ray tubes house an electron gun for emitting a plurality (usually three) of electron beams at one end of an evacuated envelope, a phosphor screen formed of phosphors coated on an inner surface of the evacuated envelope at the other end thereof for emitting light of a plurality (usually three) of colors, and a shadow mask which serves as a color selection electrode and is closely spaced from the phosphor screen. The electron beams emitted from the electron gun are deflected to scan the phosphor screen two-dimensionally by magnetic fields generated by a deflection yoke mounted externally of the evacuated envelope and to display a desired image on the phosphor screen.

FIG. 17 shows a cross-sectional view for explaining an example of the constitution of the shadow mask type color cathode ray tube, and in FIG. 17, reference numeral 201 denotes a panel portion forming a viewing screen, 202 denotes a neck portion for housing an electron gun, 203 denotes a funnel portion for connecting the panel portion and the neck portion, 204 denotes a phosphor screen, 205 denotes a shadow mask serving as a color selection electrode, 206 denotes a mask frame for supporting the shadow mask 205, 207 denotes a magnetic shield for shielding extraneous magnetic fields such as the earth's magnetic field, 208 denotes a mask suspension mechanism, 9 denotes an in-line type electron gun, 10 denotes a deflection yoke, 11 denotes an internal conductive coating, 12 denote stem pins, and 13 denotes a getter.

In the case of the color cathode ray tube, the evacuated envelope is comprised of the panel portion 201, the neck portion 202 and the funnel portion 203, and electron beams B (one center electron beam and two side electron beams) emitted from the electron gun 9 housed in the neck portion 202 scan the phosphor screen 204 in two dimensions by the horizontal and vertical direction magnetic fields produced by the deflection yoke 10.

The deflection yoke 10 is of a self-converging type which provides a pin cushion-like horizontal deflection magnetic field and a barrel-like vertical deflection magnetic field to converge a plurality of electron beams over the entire phosphor screen.

The electron beams B are modulated in amount by modulating signals such as video signals supplied via the stem pins 12, are color-selected by the shadow mask 205 disposed immediately in front of the phosphor screen 204, and impinge upon the phosphors of the corresponding colors to reproduce a desired image.

The cathode ray tubes of this kind are provided with a multistage focus lens in the electron gun and a dynamic focusing system is widely adopted where at least one of the electrodes constituting the multistage focus lens is supplied with a voltage varying dynamically, to obtain sufficiently small electron beam spots over the entire phosphor screen.

FIG. 18 is a schematic cross-sectional view of an example of an electrode structure of an electron gun employed in a color cathode ray tube, taken perpendicular to the in-line direction of three in-line electron beams.

In FIG. 18, reference numeral 1 denote three cathodes each having a heater incorporated therein, and electron beam generating means comprises the cathodes 1, a first electrode 2 serving as a control electrode and a second electrode 3 serving as an accelerating electrode and the electron beam generating means forms electrons generated by the three cathodes 1 into three respective electron beams. Electron beam focusing means comprises a third electrode 4, a fourth electrode 5, a fifth electrode 6 and an anode 7, and the electron beam focusing means accelerates the three electron beams and focuses them on the phosphor screen 204. Reference numeral 8 denotes a shield cup and Eb is an anode voltage. The fifth electrode 6 is divided into a first member 61 and a second member 62.

The third electrode 4, the fourth electrode 5 and the first member 61 of the fifth electrode 6 form a first-stage focusing lens, and the second member 62 of the fifth electrode 6 and the anode 7 form a second-stage focusing lens.

The electrons emitted from the cathodes 1 heated by the heaters are accelerated toward the first electrode 2 serving as an electron beam control electrode by an accelerating potential of the second electrode 3 to form three electron beams. After passing through the electron beam apertures in the second electrode 3 and the third electrode 4, the three electron beams are slightly focused by the first-stage focusing lens formed by the third electrode 4, the fourth electrode 5 and the first member 61 of the fifth electrode 6.

After passing through the first-stage focusing lens, the electron beams enter the second-stage focusing lens formed by the second member 62 of the fifth electrode 6 and the anode 7 and serving as a main lens.

In FIG. 18, reference numeral 63 denotes a correction plate electrode disposed within the second member 62 of the fifth electrode 6 and 71 is a correction plate electrode disposed within the anode 7.

The three respective electron beams are focused while they pass through the second-stage focusing lens, then are subjected to color selection by the shadow mask 205, and then are focused on phosphor elements of an intended color of the phosphor screen 204 to form an electron beam spot.

A first focusing voltage Vf1 of a fixed voltage is applied to the third electrode 4 and the first member 61 of the fifth electrode 6, and a second focusing voltage (Vf2+dVf) of a fixed voltage Vf2 superposed with a dynamic voltage dVf varying in synchronism with deflection angle of the electron beams scanning the phosphor screen 204 is applied to the second member 62 of the fifth electrode 6. With this structure, the curvature of the image field is corrected by varying the strength of the main lens according to the deflection angle of the electron beams.

In addition to the above structure, an electrostatic quadrupole lens is formed by four vertical plates 611 attached to the end of the first member 61 of the fifth electrode 6 on the second member 62 side thereof and two horizontal plates 621 attached to the end of the second member 62 of the fifth electrode 6 on the first member 61 side thereof. With the electrostatic quadrupole lens being configured so as to focus the electron beams horizontally and so as to diffuse the electron beams vertically according to increasing deflection angles of the electron beams, the electrostatic quadrupole lens corrects astigmatic deflection defocusing induced by the deflection yoke which diffuses the electron beams horizontally and focuses the electron beams vertically according to the increasing deflection angles of the electron beams. With this structure, a good focus is obtained over the entire viewing screen.

But electron guns for use in color cathode ray tubes such as TV picture tubes and display monitor tubes need to control the cross-sectional shape of the electron beams properly according to the amount of electron beam deflection so as to provide a good focus characteristic and high resolution over the entire viewing screen.

With the above electron gun, the cross-sectional shape of the electron beams entering the main lens is elongated vertically according to the increasing deflection angle of the electron beams by the astigmatism-correcting electrostatic quadrupole lens, consequently the vertical diameter of the cross section of the electron beams is influenced greatly by the deflection defocusing which compresses the vertical diameter of the cross section of the electron beams and expands the horizontal diameter of the cross section to elongate the cross section horizontally, and as a result the electron beam spots are elongated horizontally at the periphery of the viewing screen and it was difficult to obtain good and uniform focus over the entire viewing screen.

To eliminate the above problem, in addition to the above electrostatic quadrupole lens, another electrostatic quadrupole lens serving as an electron beam shaping lens is formed by dividing the fifth electrode again or by dividing the third electrode again and is disposed in a position remoter from the anode than the above electrostatic quadrupole lens is.

The additional electrostatic quadrupole lens diffuses the electron beams in the direction in which the anode-side electrostatic quadrupole lens focuses the electron beams and focuses the electron beams in the direction in which the anode-side electrostatic quadrupole lens diffuses the electron beams such that the additional electrostatic quadrupole lens has opposite effects on the electron beams from the anode-side electrostatic quadrupole lens.

With this structure, the electrostatic quadrupole lens for shaping the electron beams can be configured so as to elongate the cross section more horizontally according to the increase in the electron beam deflection and the astigmatism-correcting electrostatic quadrupole lens can shape the cross-sectional shape of the electron beams easily, and consequently good and uniform focus can be obtained over the entire viewing screen.

But there is a problem in that sufficient shaping action of elongating the cross section of the electron beams horizontally cannot be obtained even when the electron beam-shaping electrostatic quadrupole lens is formed within the third electrode remotest from the anode so as to shape the electron beams most effectively, and consequently good and uniform focus cannot be obtained over the entire viewing screen.

SUMMARY OF THE INVENTION

It is an object of the present invention to provide a high resolution color cathode ray tube having eliminated the problems of the prior art and optimized the shape of the electron beam spots over the entire viewing screen.

To accomplish the above objects, in accordance with an embodiment of the present invention, there is provided a color cathode ray tube comprising an evacuated envelope comprising a panel portion, a neck portion and a funnel portion for connecting said panel portion and said neck portion, a phosphor screen formed on an inner surface of said panel portion, an in-line type electron gun housed in said neck portion, and an electron beam deflection yoke mounted around said neck portion, said in-line type electron gun comprising an electron beam generating section having a plurality of in-line cathodes, a first electrode serving as an electron beam control electrode and a second electrode serving as an accelerating electrode arranged in the order named for projecting a plurality of electron beams arranged approximately in parallel with each other in a horizontal plane toward said phosphor screen, an electron beam focusing section comprising a third electrode, a fourth electrode, a fifth electrode and an anode arranged in the order named for focusing said plurality of electron beams on said phosphor screen, said third electrode comprising a first group of members and a second group of members of said third electrode, said fifth electrode comprising a first group of members and a second group of members of said fifth electrode, said first group of members of said third electrode and said first group of members of said fifth electrode being supplied with a first focus voltage of a fixed value, and said second group of members of said third electrode and said second group of members of said fifth electrode being supplied with a second focus voltage comprised of a fixed voltage and a dynamic voltage varying with deflection of said plurality of electron beams, wherein at least one first-type electrostatic quadrupole lens is formed between said first and second groups of members of said fifth electrode for increasingly focusing said plurality of electron beams in one of horizontal and vertical directions and for increasingly diffusing said plurality of electron beams in another of the horizontal and vertical directions with an increase in a focus voltage difference between said first focus voltage and said second focus voltage, at least one second-type electrostatic quadrupole lens is formed between said first and second groups of members of said third electrode for increasingly focusing said plurality of electron beams with the increase in the focus voltage difference in a direction perpendicular to said one of the horizontal and vertical directions in which one disposed nearest said anode, of said at least one first-type electrostatic quadrupole lens increasingly focuses said plurality of electron beams with the increase in the focus voltage difference, and for increasingly diffusing said plurality of electron beams with the increase in the focus voltage difference in a direction perpendicular to said another of the horizontal and vertical directions in which said one disposed nearest said anode, of said at least one first-type electrostatic quadrupole lens increasingly diffuses said plurality of electron beams with the increase in the focus voltage difference, and an electron lens is formed between said fourth electrode and a first aperture formed in a first surface of one member of said second group of said third electrode adjacent to said fourth electrode and forming said at least one second-type electrostatic quadrupole lens in combination with one member of said first group of said third electrode, said first surface of said one member of said second group of said third electrode being on a side of said one member of said second group of said third electrode opposite from said fourth electrode, said electron lens being configured so as to increasingly diffuse said plurality of electron beams in the horizontal direction with an increase in a voltage difference between said second focus voltage and a voltage applied to said fourth electrode and to increasingly focus said plurality of electron beams in the vertical direction with the increase in the voltage difference between said second focus voltage and the voltage applied to said fourth electrode.

To accomplish the above objects, in accordance with another embodiment of the present invention, there is provided a color cathode ray tube comprising an evacuated envelope comprising a panel portion, a neck portion and a funnel portion for connecting said panel portion and said neck portion, a phosphor screen formed on an inner surface of said panel portion, an in-line type electron gun housed in said neck portion, and an electron beam deflection yoke mounted around said neck portion, said in-line type electron gun comprising an electron beam generating section having three in-line cathodes, an electron beam control electrode and an accelerating electrode arranged in the order named for projecting three electron beams arranged approximately in parallel with each other in a horizontal plane toward said phosphor screen, an electron beam focusing section comprising a third electrode, a fourth electrode, a fifth electrode and an anode arranged in the order named for focusing the three electron beams on said phosphor screen, said third electrode comprising a first group of members and a second group of members of said third electrode, said fifth electrode comprising a first group of members and a second group of members of said fifth electrode, one member of said second group of members of said fifth electrode being disposed adjacently to said anode, said first group of members of said third electrode and said first group of members of said fifth electrode being supplied with a first focus voltage of a fixed value, and said second group of members of said third electrode and said second group of members of said fifth electrode being supplied with a second focus voltage comprised of a fixed voltage and a dynamic voltage varying with deflection of the three electron beams, wherein at least one first-type electrostatic quadrupole lens is formed between said first and second groups of members of said fifth electrode for increasingly focusing the three electron beams in one of horizontal and vertical directions and for increasingly diffusing the three electron beams in another of the horizontal and vertical directions with an increase in a focus voltage difference between said first focus voltage and said second focus voltage, at least one second-type electrostatic quadrupole lens is formed between said first and second groups of members of said third electrode for increasingly focusing the three electron beams with the increase in the focus voltage difference in a direction perpendicular to said one of the horizontal and vertical directions in which one disposed nearest said anode, of said at least one first-type electrostatic quadrupole lens increasingly focuses the three electron beams with the increase in the focus voltage difference, and for increasingly diffusing the three electron beams with the increase in the focus voltage difference in a direction perpendicular to said another of the horizontal and vertical directions in which said one disposed nearest said anode, of said at least one first-type electrostatic quadrupole lens increasingly diffuses the three electron beams with the increase in the focus voltage difference, and an electron lens is formed between said fourth electrode and an aperture formed in one member of said second group of said third electrode adjacent to said fourth electrode and forming said at least one second-type electrostatic quadrupole lens in combination with one member of said first group of said third electrode, said one member of said second group of said third electrode being a plate-like electrode and said aperture being a vertically elongated aperture, said electron lens being configured so as to increasingly diffuse the three electron beams in the horizontal direction with an increase in a voltage difference between said second focus voltage and a voltage applied to said fourth electrode and to increasingly focus the three electron beams in the vertical direction with the increase in the voltage difference between said second focus voltage and the voltage applied to said fourth electrode.

The invention is not limited to particular details of the above-explained construction and the below-explained embodiments. Various changes and modifications can be made to the above-explained structures and the below-explained embodiments without departing from the spirit and scope of the invention as defined in the appended claims.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

Figure 1:
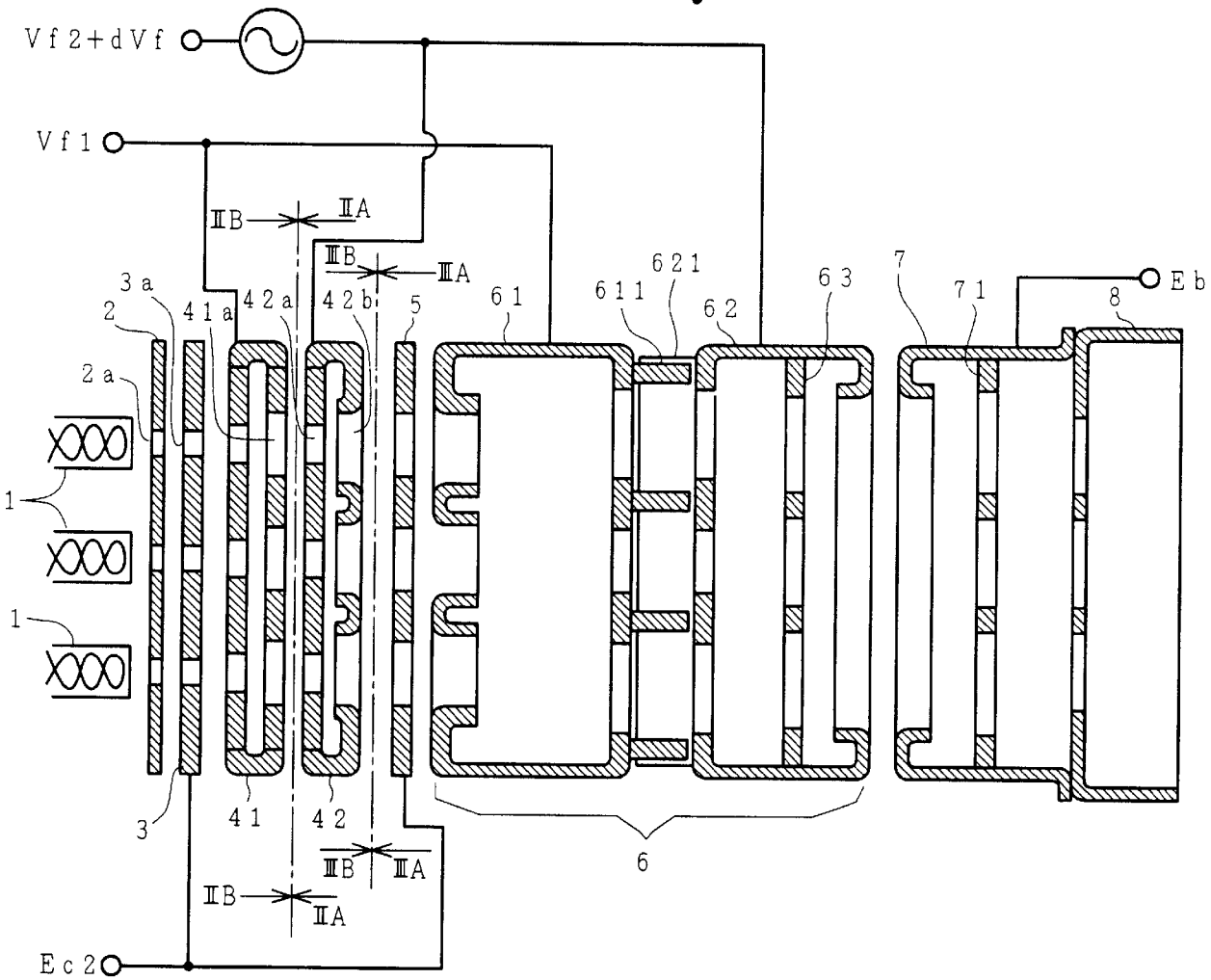
FIG. 1 is a schematic cross-sectional view of an electron gun for explaining a color cathode ray tube in accordance with a first embodiment of the present invention.

The detailed explanation will be given to the embodiments according to the present invention referring to the drawings.

Figure 18:
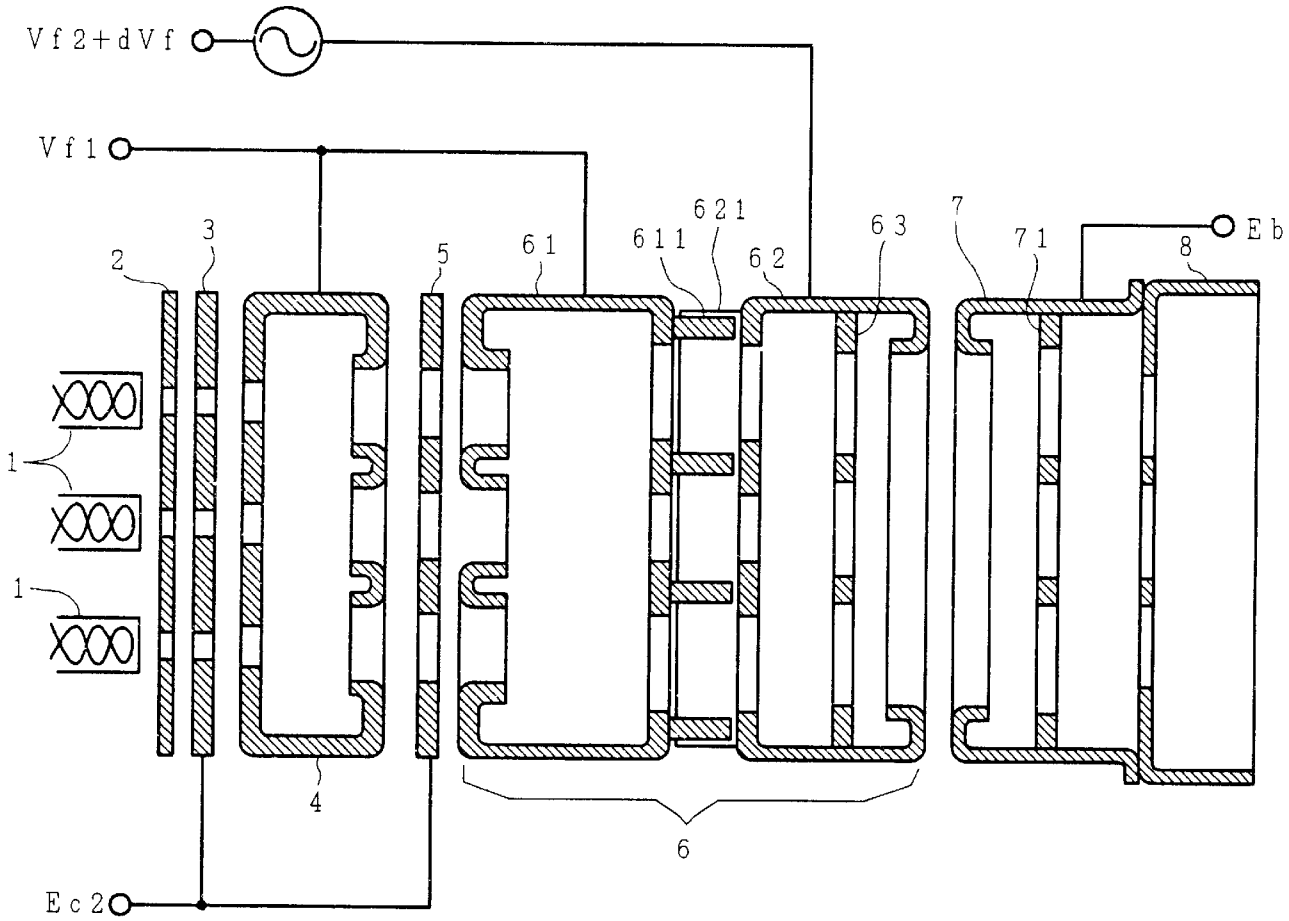
FIG. 18 (PRIOR ART)
FIG. 18 is a schematic cross-sectional view of an example of a prior art electron gun used in a color cathode ray tube.

FIG. 1 is a schematic cross-sectional view of an electron gun viewed in a direction perpendicular to the in-line direction of the three in-line electron beams for explaining a first embodiment of a color cathode ray tube according to the present invention. The same reference numerals as utilized in FIG. 18 designate corresponding portions in FIG. 1.

In this embodiment, electron beam generating means comprises cathodes 1, a first electrode 2 serving as a control electrode and a second electrode 3 serving as an accelerating electrode, and electron beam focusing means comprises a first member 41 and a second member 42 of a third electrode 4, a fourth electrode 5, a first member 61 and a second member 62 of a fifth electrode 6, an anode 7 and a shield cup 8.

The second electrode 3 and the fourth electrode 5 are supplied with a fixed voltage Ec2 of 400 to 1000 V, the first member 41 of the third electrode 4 and the first member 61 of the fifth electrode 6 are supplied with a first focus voltage of a fixed voltage Vf1.

The second member 42 of the third electrode 4 and the second member 62 of the fifth electrode 6 are supplied with a second focus voltage (Vf2+dVf) of a fixed voltage Vf2 superposed with a dynamic voltage dVf varying with a deflection angle of the electron beams scanning the viewing screen.

An astigmatism-correcting electrostatic quadrupole lens is formed between the first member 61 and the second member 62 of the fifth electrode for elongating the cross section of the electron beams vertically increasingly with an increase in the dynamic voltage. This electrostatic quadrupole lens is comprised of four vertical plates 611 attached to the end of the first member 61 of the fifth electrode on the second member 62 side thereof and two horizontal plates 621 attached to the second member 62 of the fifth electrode on the first member 61 side thereof.

Figure 2A:
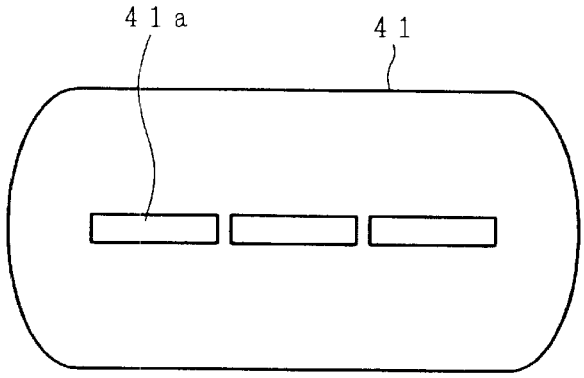
FIGS. 2A and 2B are cross-sectional views of the electron gun taken at lines IIA—IIA and IIB—IIB of FIG. 1, respectively.
Figure 2B:
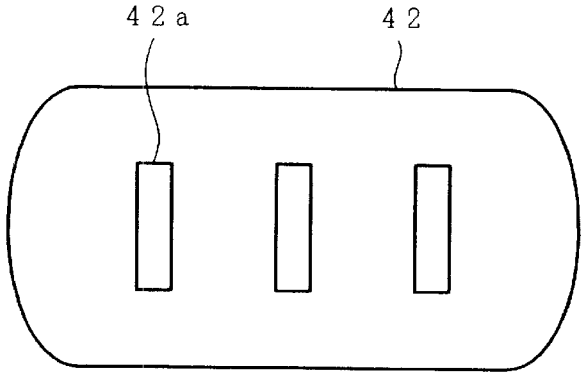

FIGS. 2A and 2B are plan views of the first member 41 and the second member 42 of the third electrode 4, respectively, FIG. 2A being an illustration of electron beam apertures 41*a* formed in a surface of the first member 41 on the second member 42 side thereof and FIG. 2B being an illustration of electron beam apertures 42*a* formed in a surface of the second member 42 on the first member 41 side thereof.

As shown in FIG. 2A, three horizontally elongated electron beam apertures 41*a* are formed in the surface of the first member 41 on the second member 42 side thereof, and as shown in FIG. 2B, three vertically elongated electron beam apertures 42*a* are formed in the surface of the second member 42 on the first member 41 side thereof.

With this structure of the electron beam apertures 41*a* and 42*a*, in the third electrode 4, an electron beam-shaping electrostatic quadrupole lens is formed between the first member 41 and the second member 42 of the third electrode 4 for elongating the cross section of the electron beams less vertically, that is, elongating the cross section of the electron beams more horizontally with an increase in the dynamic voltage.

Figure 3A:
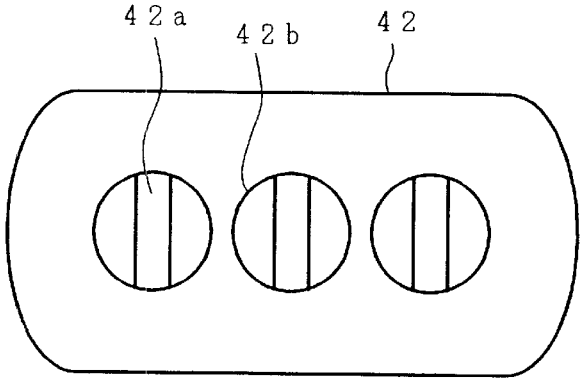
FIGS. 3A and 3B are cross-sectional views of the electron gun taken at lines IIIA—IIIA and IIIB—IIIB of FIG. 1, respectively.
Figure 3B:
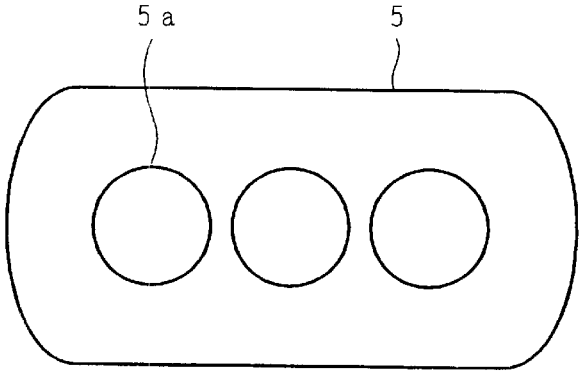
Figure 4:
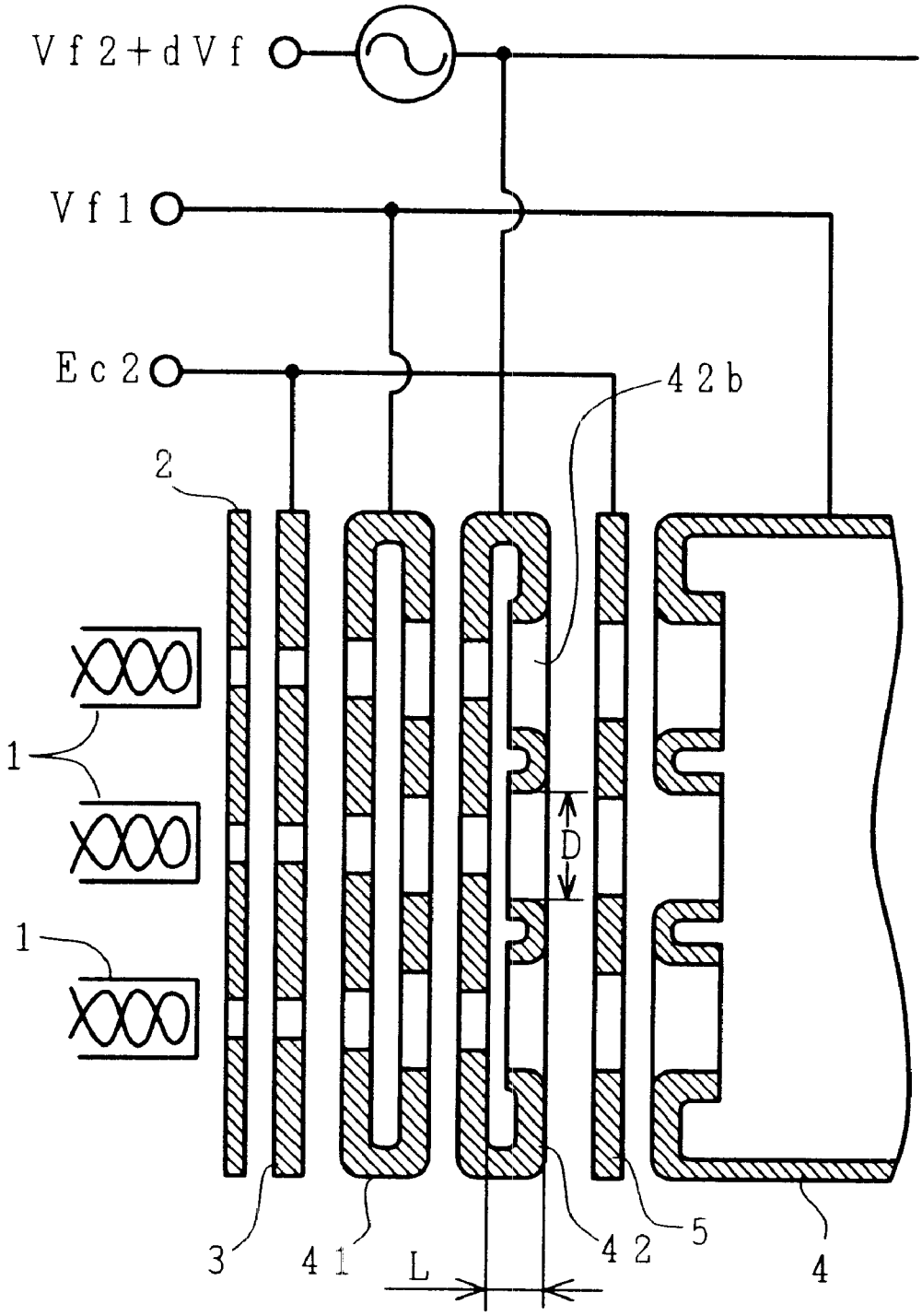
FIG. 4 is a schematic enlarged cross-sectional view of a portion of the electron gun of FIG. 1.

FIG. 3A is a plan view of the second member 42 of the third electrode 4 taken at line IIIA—IIIA of FIG. 1, and FIG. 3B is a plan view of the fourth electrode 5 taken at line IIIB—IIIB of FIG. 1. As shown in FIG. 3A, the electron beam apertures 42*b* formed in the surface of the second member 42 on the fourth electrode 5 side thereof are circular and are larger than the electron beam apertures 42*a* formed in the surface of the second member 42 on the first member 41 side thereof such that edges of the electron beam apertures 42*a* are viewed through the electron beam apertures 42*b*. As shown in FIG. 3B, the electron beam apertures 5*a* in the fourth electrode 5 are circular. FIG. 4 is an enlarged view of a portion of the electron gun of FIG. 1.

It is obvious from FIG. 3A that electric fields generated by the fourth electrode 5 extend into the electron beam apertures 42*a* of the second member 42 on the first member 41 side thereof and form non-axially-symmetric lens, because the electron beam apertures 42*b* in the surface of the second member 42 on the fourth electrode 5 side thereof are larger than the electron beam apertures 42*a* in the surface of the second member 42 on the first member 41 side thereof.

Figure 5:
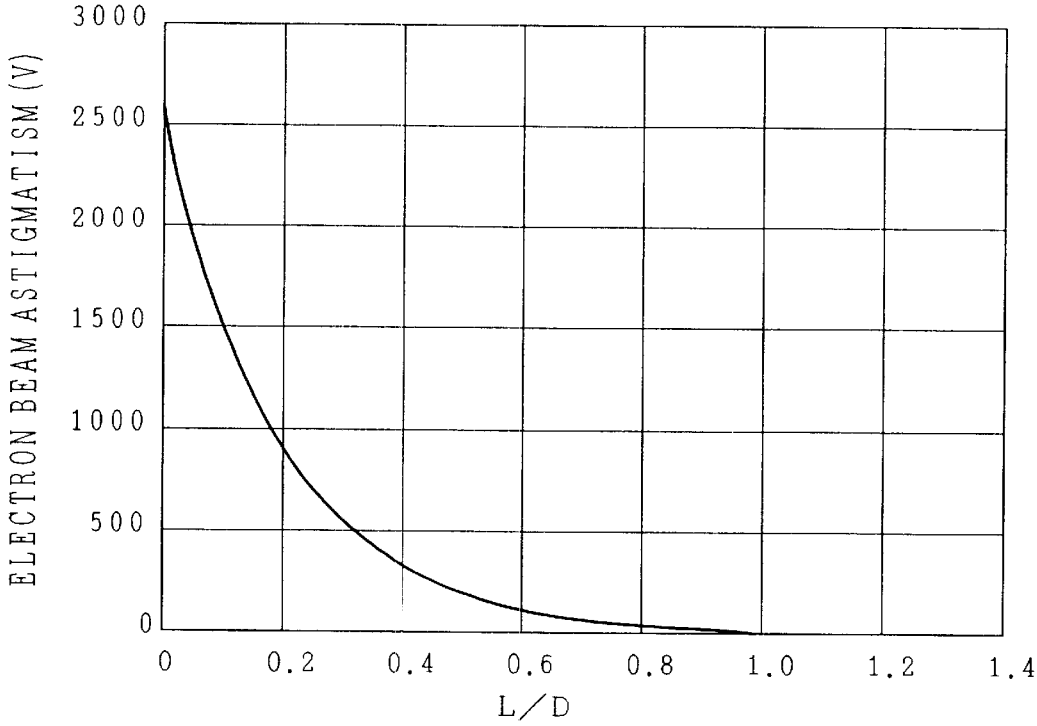
FIG. 5 is a graph showing the relationship between the electron beam astigmatism and the ratio L/D where D is a diameter of an electron beam aperture in the surface of the second member of the fourth electrode on the fourth-electrode side thereof and L is an axial distance measured from the surface of the second member on the fourth-electrode side thereof to the electron beam aperture in the surface of the second member on the first-member side thereof as indicated in FIG. 4.

The electron beam astigmatism was evaluated in terms of the difference between the optimum horizontal focus voltage and the optimum vertical focus voltage applied to the second member 42 of the third electrode 4. FIG. 5 shows the relationship between the electron beam astigmatism and the ratio L/D where D is a diameter of the electron beam aperture 42*b* in the surface of the second member 42 of the third electrode 4 on the fourth-electrode 5 side thereof and L is an axial distance measured from the surface of the second member 42 on the fourth-electrode 5 side thereof to the electron beam aperture in the surface of the second member 42 on the first-member 41 side thereof as indicated in FIG. 4.

When the electron beam astigmatism voltage is zero, no electrostatic quadrupole lens is present, and consequently it is obvious from FIG. 5 that, when the relationship of L/D<1 is satisfied, an electrostatic quadrupole lens is formed between the fourth electrode 5 and the vertically elongated apertures 42*a* in the surface of the second member 42 of the third member 4 on the first member 41 side thereof.

The voltage (Vf2+dVf) applied to the second member 42 of the third electrode and the voltage Ec2 applied to the fourth electrode 5 have the relationship (Vf2+dVf)>Ec2 at all times, and consequently an electrostatic quadrupole lens is formed between the second member 42 of the third electrode and the fourth electrode 5 such that a diverging lens is formed within the second member 42 by the vertically elongated apertures 42*a* in the surface of the second member 42 on the first member 41 side and the electron beams experience diffusing forces stronger in the horizontal direction.

Further, the electron beams experience diffusing forces increasingly stronger in the horizontal direction as the dynamic voltage dVf is increased and their cross sections are more elongated horizontally, because the potential difference between the second member 42 of the third electrode and the fourth electrode 5 increases as the dynamic voltage dVf is increased.

The electron lens formed between the second member 42 of the third electrode and the fourth electrode 5 elongates the cross section of the electron beams increasingly in the horizontal direction as the dynamic voltage dVf is increased like the electrostatic quadrupole lens formed between the first member 41 and the second member 42 of the third electrode, and this additional horizontal elongation of the cross section of the electron beams increases the amount of the beam shaping and provides a sufficient amount of shaping of the electron beams. Therefore the present embodiment provides good and uniform focus over the entire viewing screen.

Figure 6A:
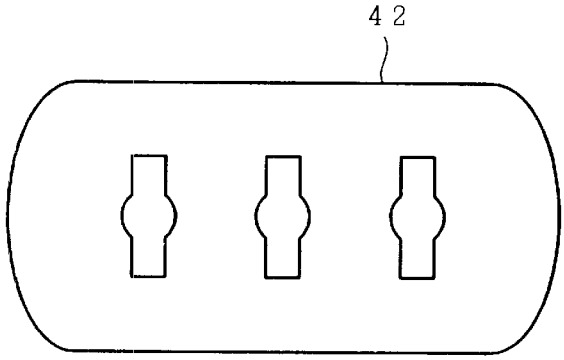
FIG. 6A is a plan view of a surface of a modification of the second member of the third electrode on the first member side thereof.
Figure 6B:
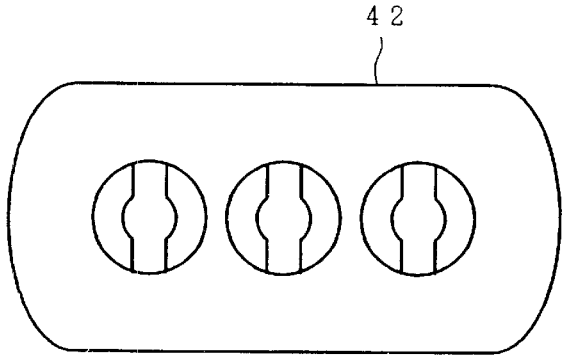
FIG. 6B is a plan view of the surface viewed through an aperture in a surface of the second member on the fourth electrode side thereof.

As a modification, the electron beam apertures in the surface of the second member 42 of the third electrode 4 on the first member 41 side thereof may be made in the form of vertically elongated keyholes as shown in FIG. 6A, but the electron beam apertures in the fourth electrode is circular. FIG. 6B is a plan view of the modification of the second member 42 taken at line IIIA—IIIA of FIG. 1. In this modification also, the electron lens formed between the second member 42 of the third electrode and the fourth electrode 5 elongates the cross section of the electron beams increasingly in the horizontal direction as the dynamic voltage dVf is increased and this additional horizontal elongation of the cross section of the electron beams increases the amount of the beam shaping and provides a sufficient amount of shaping of the electron beams. Therefore this modification provides good and uniform focus over the entire viewing screen.

Figure 7:
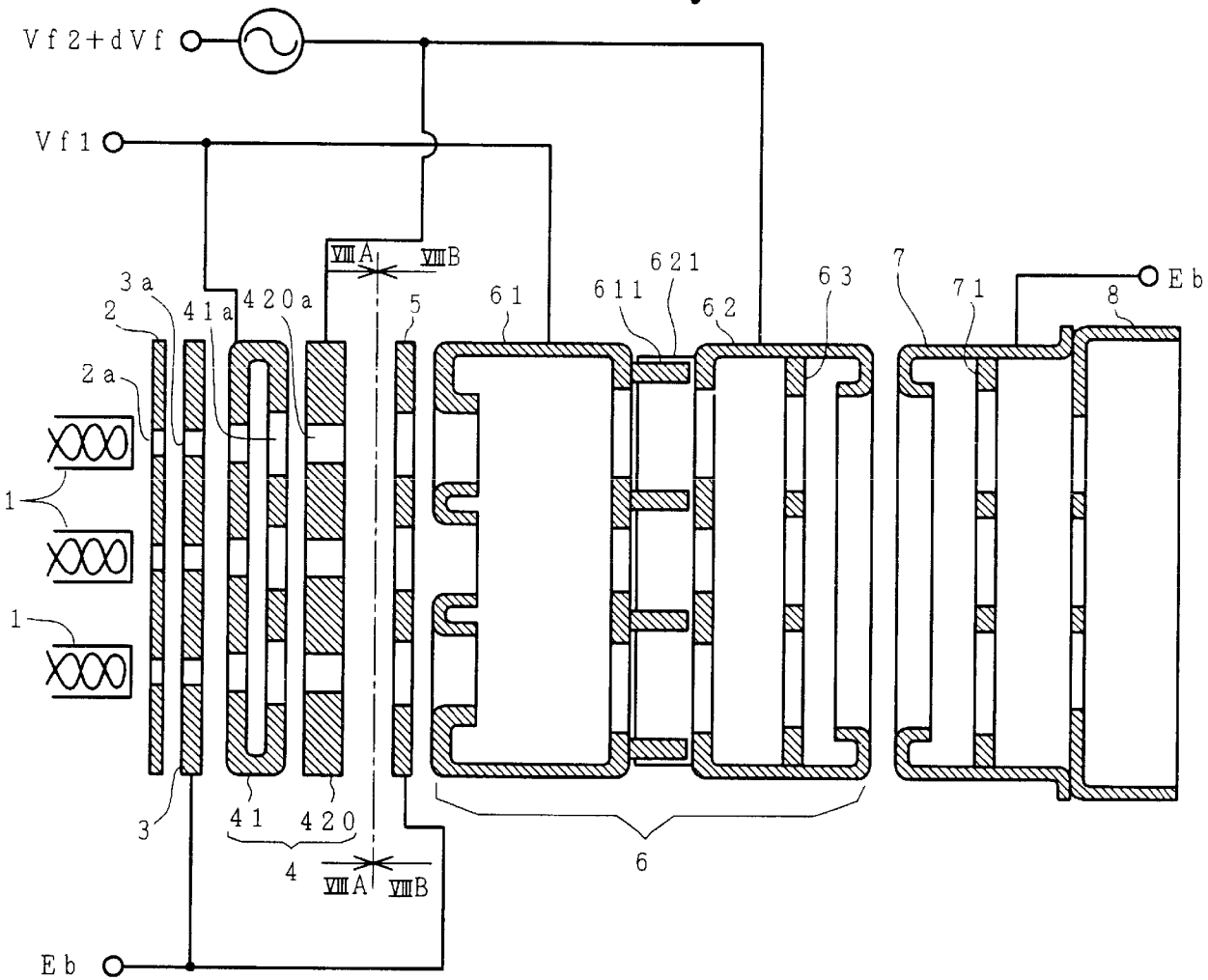
FIG. 7 is a schematic cross-sectional view of an electron gun for explaining a color cathode ray tube in accordance with a second embodiment of the present invention.

FIG. 7 is a schematic cross-sectional view of an electron gun viewed in a direction perpendicular to the in-line direction of the three in-line electron beams for explaining a second embodiment of a color cathode ray tube according to the present invention. The same reference numerals as utilized in FIG. 1 designate corresponding portions in FIG. 7.

The electron gun of this embodiment is similar to that of the previous embodiment, except that the second member 420 of the third electrode 4 is of a plate electrode type in this embodiment.

Figure 8A:
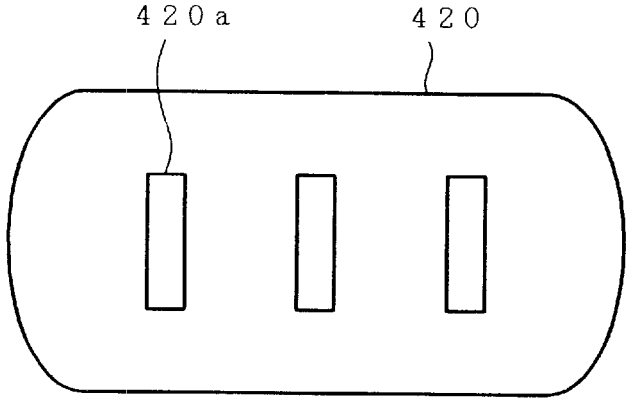
FIGS. 8A and 8B are cross-sectional views of the electron gun taken at lines VIIIA—VIIIA and VIIIB—VIIIB of FIG. 7, respectively.
Figure 8B:
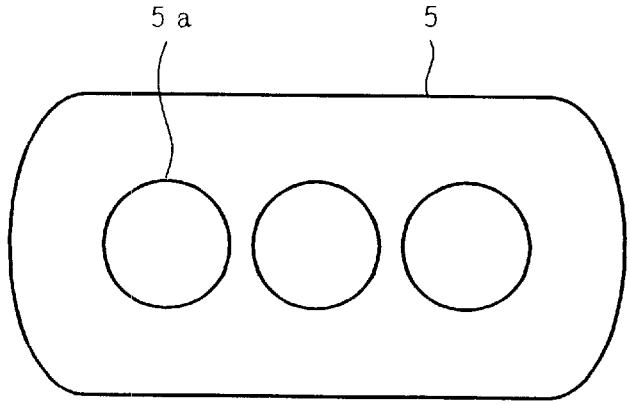

FIG. 8A is a plan view of the second member 420 of the third electrode 4 taken at line VIIIA—VIIIA of FIG. 7, and FIG. 8B is a plan view of the fourth electrode 5 taken at line VIIIB—VIIIB of FIG. 1. The electron beam apertures 420*a* in the second member 420 of the third electrode 4 are vertically elongated and the apertures 5*a* in the fourth electrode 5 is circular.

The voltage (Vf2+dVf) applied to the second member 420 of the third electrode and the voltage Ec2 applied to the fourth electrode 5 have the relationship (Vf2+dVf)>Ec2 at all times, and consequently an electrostatic quadrupole lens is formed between the second member 420 of the third electrode and the fourth electrode 5 such that the electron beams experience diffusing forces caused by the vertically elongated apertures 420*a* in the second member 420 and stronger in the horizontal direction.

Further, the electron beams experience diffusing forces increasingly stronger in the horizontal direction as the dynamic voltage dVf is increased and their cross sections are more elongated horizontally, because the potential difference between the second member 420 of the third electrode and the fourth electrode 5 increases as the dynamic voltage dVf is increased.

The electron lens formed between the second member 420 of the third electrode and the fourth electrode 5 elongates the cross section of the electron beams increasingly in the horizontal direction as the dynamic voltage dVf is increased like the electrostatic quadrupole lens formed between the first member 41 and the second member 420 of the third electrode, and this additional horizontal elongation of the cross section of the electron beams increases the amount of the beam shaping and provides a sufficient amount of shaping of the electron beams. Therefore the present embodiment provides good and uniform focus over the entire viewing screen.

Figure 8C:
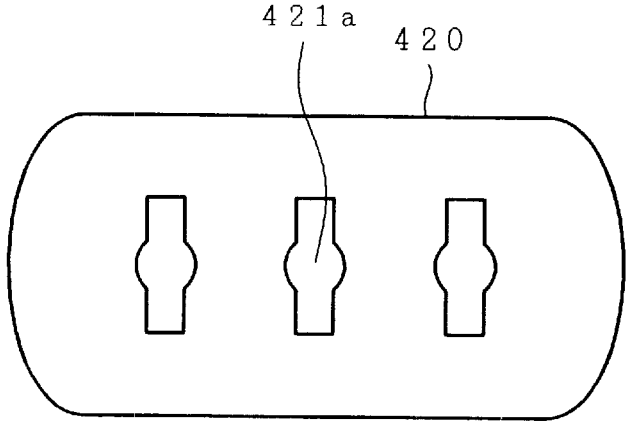
FIG. 8C is a plan view of a modification of the second member of third electrode in FIG. 7.

As a modification of the electron gun of FIG. 7 in the second embodiment, the electron beam apertures 421*a* in the second member 420 of the third electrode 4 may be made in the form of vertically elongated keyholes as shown in FIG. 8C. FIG. 8C is a plan view of the modification of the second member 420 taken at line VIIIA—VIIIA of FIG. 7. In this modification also, the electron lens formed between the second member 420 of the third electrode and the fourth electrode 5 elongates the cross section of the electron beams increasingly in the horizontal direction as the dynamic voltage dVf is increased and this additional horizontal elongation of the cross section of the electron beams increases the amount of the beam shaping and provides a sufficient amount of shaping of the electron beams. Therefore this modification also provides good and uniform focus over the entire viewing screen.

Figure 9:
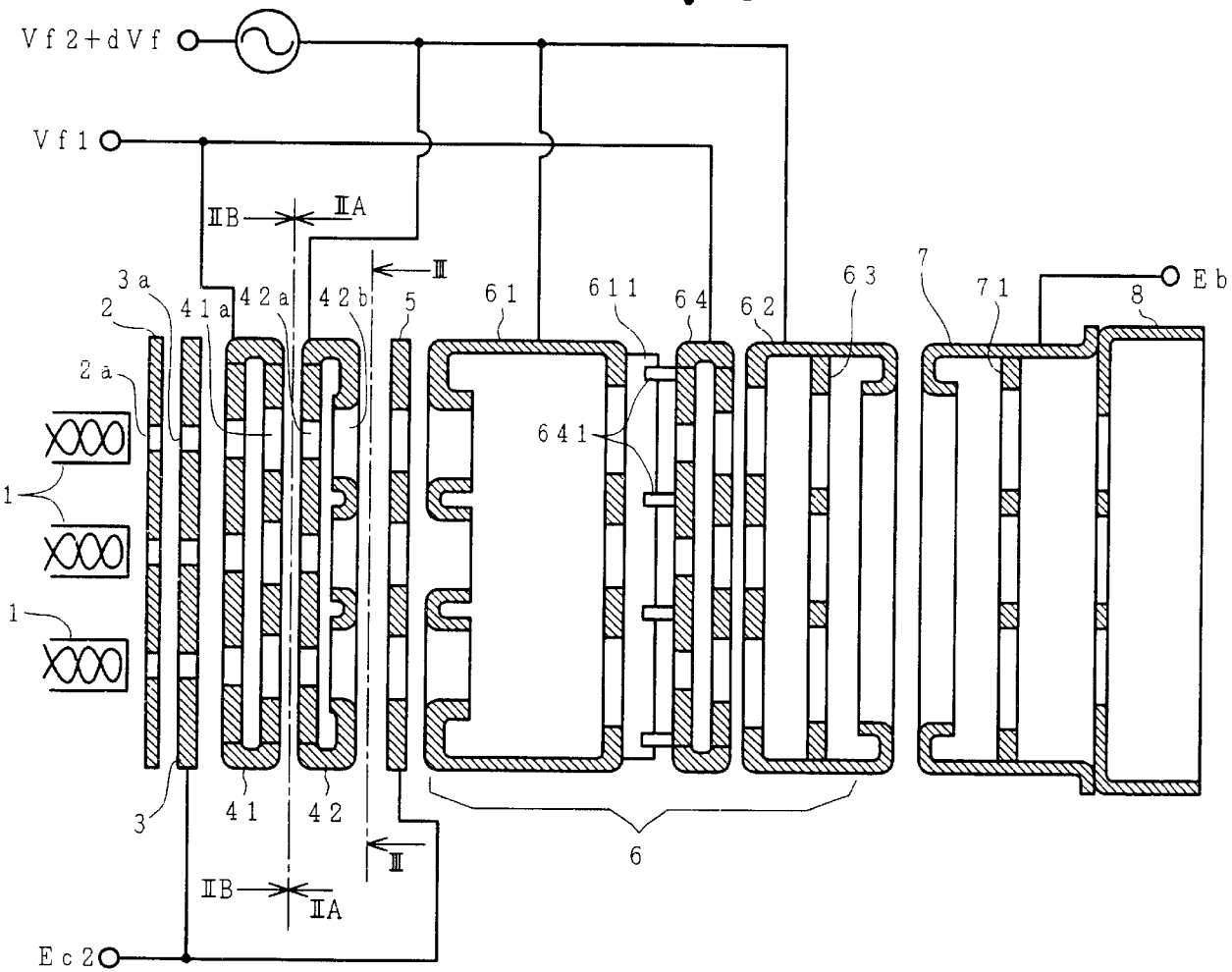
FIG. 9 is a schematic cross-sectional view of an electron gun for explaining a color cathode ray tube in accordance with a third embodiment of a color cathode ray tube according to the present invention.

FIG. 9 is a schematic cross-sectional view of an electron gun viewed in a direction perpendicular to the in-line direction of the three in-line electron beams for explaining a third embodiment of a color cathode ray tube according to the present invention. The same reference numerals as utilized in FIG. 1 designate corresponding portions in FIG. 9.

The present embodiment differs from the first and second embodiments in that the fifth electrode 6 are divided into a first member 61, a second member 62 and a third member 64 and in that the first member 61 and the second member 62 are supplied with a second focus voltage (Vf2+dVf) of a fixed voltage Vf2 superposed with a dynamic voltage dVf and the third member 64 is supplied with a fixed focus voltage Vf1.

An electrostatic quadrupole lens is formed by two horizontal plates 611 attached to the end of the first member 61 on the third member 64 side thereof and four vertical plates 641 attached to the end of the third member 64 on the first member 61 side thereof. The electron beam apertures 41*a* and 42*a* in the third electrode 4 are similar to those in the third electrode 4 in FIGS. 2A and 2B, respectively, and a cross-sectional view of the third electrode 4 taken at line III—III of FIG. 9 is similar to that of FIG. 3A.

The second electrode 3 and the fourth electrode 5 are supplied with a fixed voltage Ec2 of about 400 V to about 1000 V, the first member 41 of the third electrode and the third member 64 of the fifth electrode are supplied with a first focus voltage Vf1, and the second member 42 of the third electrode and the first member 61 and the second member 62 of the fifth electrode are supplied with a second focus voltage (Vf2+dVf) of a fixed voltage Vf2 superposed with a dynamic an voltage dVf varying with deflection angle of the electron beams scanning the viewing screen.

An astigmatism-correcting electrostatic quadrupole lens is formed between the first member 61 and the third member 64 of the fifth electrode for increasingly elongating the cross section of the electron beams vertically as the dynamic voltage dVf increases, and an electron lens is formed between the third member 64 and the second member 62 of the fifth electrode for decreasing the strength of focusing the electron beams in both the horizontal and vertical directions as the dynamic voltage dVf increases.

As shown in FIG. 2A, three horizontally elongated electron beam apertures 41*a* are formed in the surface of the first member 41 of the third electrode 4 on the second member 42 side thereof, and as shown in FIG. 2B, three vertically elongated electron beam apertures 42*a* are formed in the surface of the second member 42 of the third electrode 4 on the first member 41 side thereof. An electron beam-shaping electrostatic quadrupole lens is formed between the first member 41 and the second member 42 of the third, electrode for increasingly elongating the cross section of the electron beams with an increase in the dynamic voltage dVf.

With this structure of the electron gun, the electron lens formed between the third member 64 and the second member 62 of the fifth electrode focuses the electron beams in both the horizontal and vertical directions. As the dynamic voltage dVf increases, that is, as the deflection of the electron beams increases, the focusing strength of the electron lens formed between the third and second members 64, 62 of the fifth electrode weakens due to the decrease in the potential difference between the third member 64 and the second member 62, and consequently the curvature of the image field is corrected.

In this embodiment, in addition to an electron lens formed between the fifth electrode 6 and the anode 7 for correcting the curvature of the image field as in the first and second embodiments, another electron lens is formed between the third member 64 and the second member 62 of the fifth electrode for correcting the curvature of the image field, and consequently the lower dynamic voltage can provide good focus over the entire viewing screen than prior art cathode ray tubes.

In this embodiment also, the electron lens formed between the second member 42 of the third electrode and the fourth electrode 5 serves to increasingly elongate the cross section of the electron beams horizontally with the increase in the dynamic voltage like the electrostatic quadrupole lens formed between the first member 41 and the second member 42 of the third electrode as in the first embodiment, such that the beam-shaping amount of horizontal elongation of the cross section of the electron beams is increased to provide a sufficient amount of the beam shaping and good and uniform focus is obtained over the entire viewing screen.

It is needless to say that this embodiment can be combined with the second embodiment.

Figure 10:
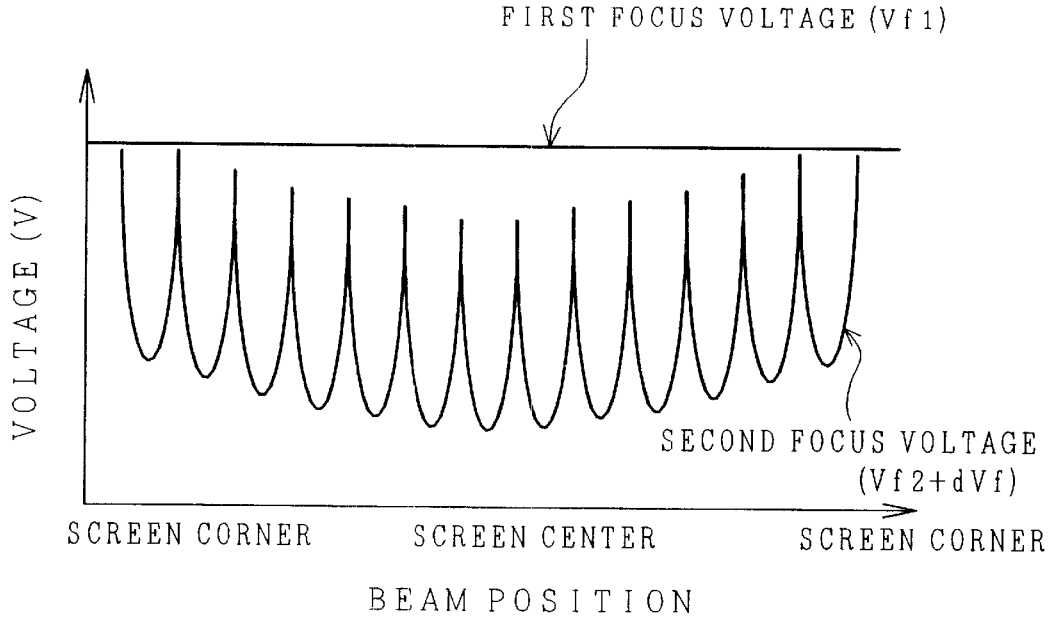
FIG. 10 is an illustration of waveforms of focus voltages.

FIG. 10 is an illustration of waveforms of the focus voltages to be used in the first to third embodiments. The fixed DC voltage Vf1 is selected higher than the fixed DC voltage Vf2 to satisfy the following relationship: the first focus voltage Vf1>the second focus voltage (Vf2+dVf).

The following explains the shapes of electron beam apertures in the respective electrodes briefly.

The electron beam apertures in the first electrode 2 are circles, squares, vertically or horizontally elongated ovals or ellipses, or vertically or horizontally elongated rectangles.

The electron beam apertures in the second electrode 3 are circles, squares, or rectangles. Sometimes each aperture in the second electrode is superposed with a rectangular slit in a surface of the second electrode on a first- or third-electrode side thereof.

The electron beam apertures in a surface of the first member 41 of the third electrode 4 on a second-electrode 3 side are circles, and those in a surface of the first member 41 on a second-member 42 side are horizontally elongated rectangles or horizontally elongated keyholes.

The electron beam apertures in the second member 42 of the third electrode 4 have already been explained above.

The electron beam apertures in the fourth electrode 5 are circles.

The electron beam apertures in a surface of the fifth electrode 6 on a fourth-electrode 5 side are circles.

Figure 11A:
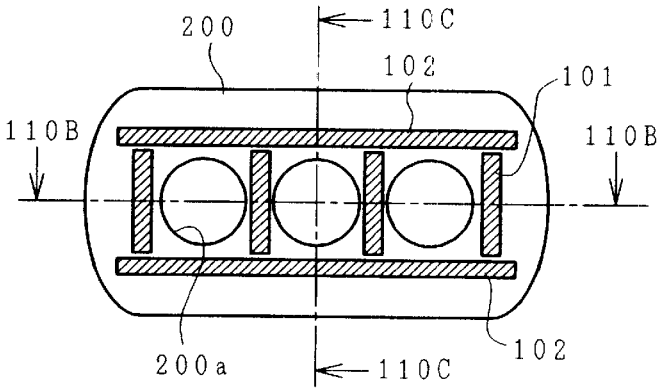
FIGS. 11A to 11C are illustrations of one type of an electrostatic quadrupole lens, FIG. 11A being a cross-sectional view of the electrostatic quadrupole lens of FIG. 11B taken along line 110A—110A, FIG. 11B being a cross-sectional view of the electrostatic quadrupole lens of FIG. 11A taken along line 110B—110B, and FIG. 11C being a cross-sectional view of the electrostatic quadrupole lens of FIG. 11A taken along line 110C—110C.
Figure 11C:
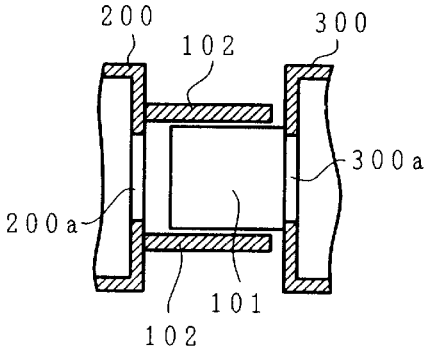
Figure 11B:
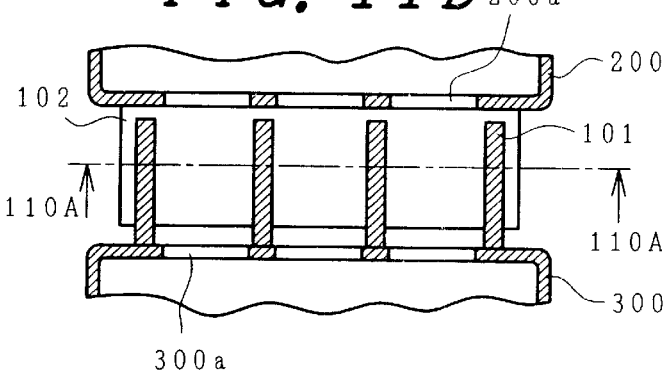

The following are some examples of astigmatism-correcting electrostatic quadrupole lenses formed within the fifth electrode 6:

(1) As shown in FIGS. 11A to 11C and explained in connection with the first to third embodiments, an quadrupole lens is formed by four vertical plates 101 attached to one electrode 300 of a pair of opposing electrodes 200, 300 and two horizontal plates 102 attached to the other 200 of the opposing electrodes 200, 300 to sandwich the four vertical plates 101. FIG. 11A is a cross-sectional view taken at line 110A—110A in FIG. 11B, FIG. 11B is a cross-sectional view taken at line 110B—110B in FIG. 1A, and FIG. 11C is a cross-sectional view taken at line 110C—110C in FIG. 11A. Reference numerals 200*a* and 300*a* denote circular apertures.

Figure 12A:
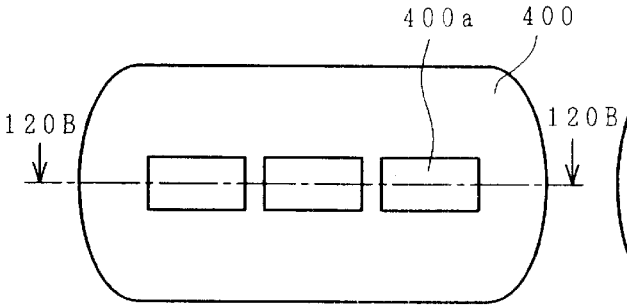
FIGS. 12A to 12C are illustrations of another type of an electrostatic quadrupole lens, FIG. 12A being a cross-sectional view of the electrostatic quadrupole lens of FIG. 11B taken along line 120A—120A, FIG. 12B being a cross-sectional view of the electrostatic quadrupole lens of FIG. 12A taken along line 120B—120B, and FIG. 11C being a cross-sectional view of the electrostatic quadrupole lens of FIG. 12B taken along line 110C—110C.
Figure 12C:
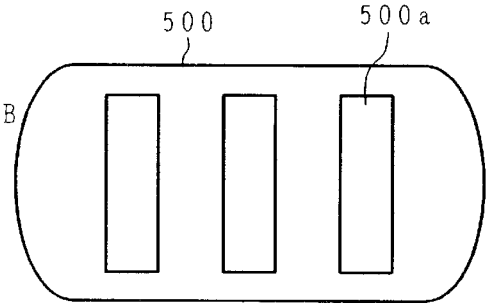
Figure 12B:
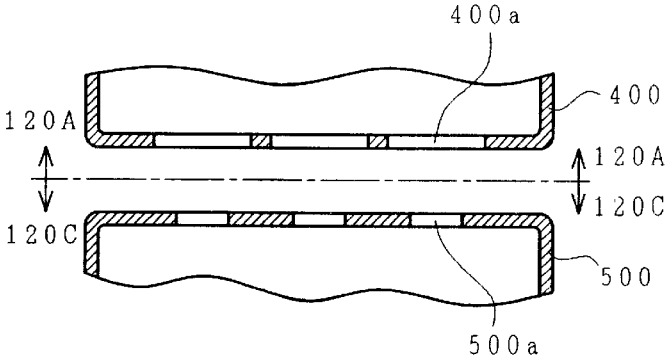

(2) As shown in FIGS. 12A to 12C, an quadrupole lens is formed by three vertically elongated rectangles 500*a* formed in one electrode 500 of a pair of opposing electrodes 400, 500 and three horizontally elongated rectangles 400*a* formed in the other 400 of the opposing electrodes 400, 500. FIG. 12A is a plan view taken at line 120A—120A in FIG. 12B, FIG. 12B is a cross-sectional view taken at line 120B—120B in FIG. 12A, and FIG. 12C is a plan view taken at line 120C—120C in FIG. 12B.

Figure 13A:
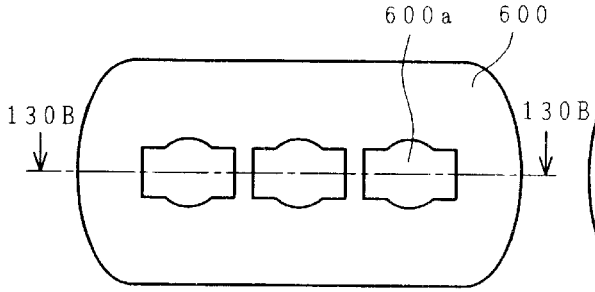
FIGS. 13A to 13C are illustrations of another type of an electrostatic quadrupole lens, FIG. 13A being a cross-sectional view of the electrostatic quadrupole lens of FIG. 13B taken along line 130A—130A, FIG. 13B being a cross-sectional view of the electrostatic quadrupole lens of FIG. 13A taken along line 130B—130B, and FIG. 13C being a cross-sectional view of the electrostatic quadrupole lens of FIG. 13B taken along line 130C—130C.
Figure 13C:
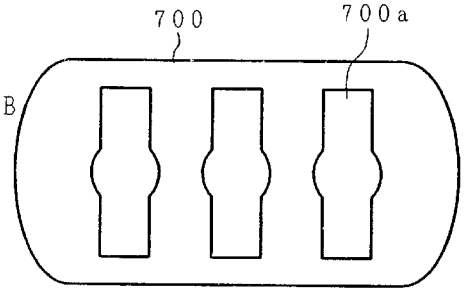
Figure 13B:
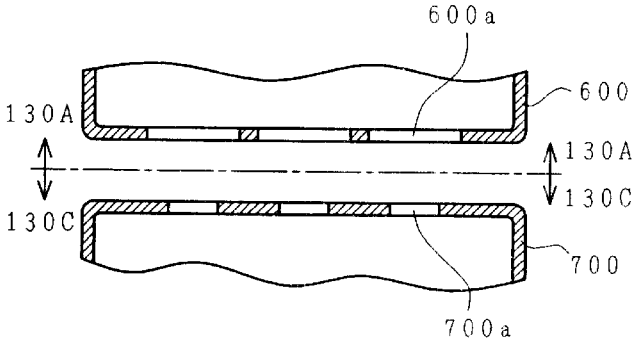

(3) As shown in FIGS. 13A to 13C, an quadrupole lens is formed by three vertically elongated keyholes 700*a* formed in one electrode 700 of a pair of opposing electrodes 600, 700 and three horizontally elongated keyholes 600*a* formed in the other 600 of the opposing electrodes 600, 700. FIG. 13A is a plan view taken at line 130A—130A in FIG. 12B, FIG. 12B is a cross-sectional view taken at line 130B—130B in FIG. 13A, and FIG. 13C is a plan view taken at line 130C—130C in FIG. 13B.

Figure 14A:
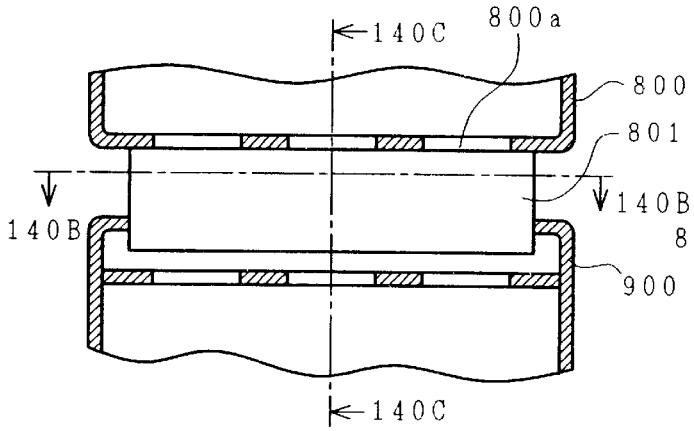
FIGS. 14A to 14C are illustrations of another type of an electrostatic quadrupole lens, FIG. 14A being a cross-sectional view of the electrostatic quadrupole lens of FIG. 14B taken along line 140A—140A, FIG. 14B being a cross-sectional view of the electrostatic quadrupole lens of FIG. 14A taken along line 140B—140B, and FIG. 14C being a cross-sectional view of the electrostatic quadrupole lens of FIG. 14A taken along line 140C—140C.
Figure 14C:
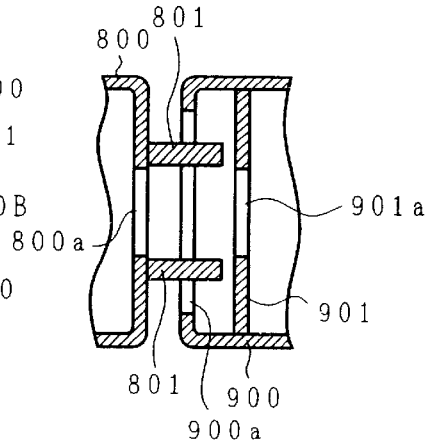
Figure 14B:
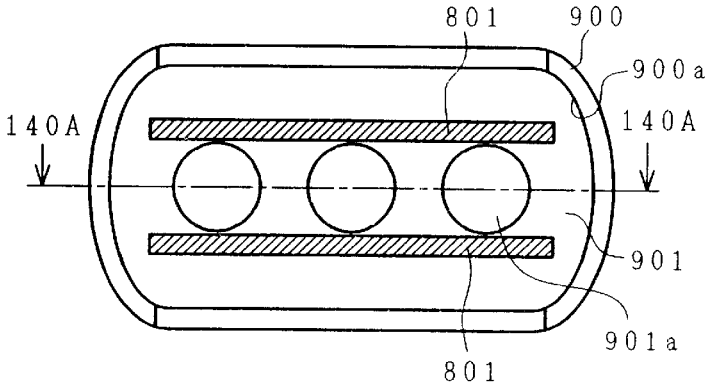

(4) As shown in FIGS. 14A to 14C, an quadrupole lens is formed by three circular apertures 901*a* formed in a plate electrode 901 disposed displaced from an end of one electrode 900 of a pair of opposing electrodes 800, 900 inwardly into the electrode 900 and a pair of horizontal plates 801 sandwiching three electron beam paths, having their edges closely spaced from the three circular apertures 901*a* and attached to the other 800 of the opposing electrodes 800, 900. FIG. 14A is a cross-sectional view taken at line 140A—140A in FIG. 14B, FIG. 14B is a cross-sectional view taken at line 140B—140B in FIG. 14A, and FIG. 14C is a cross-sectional view taken at line 140C—140C in FIG. 14A. Reference numeral 800*a* denote circular apertures and 900*a* is a large-diameter single-opening.

Figure 15A:
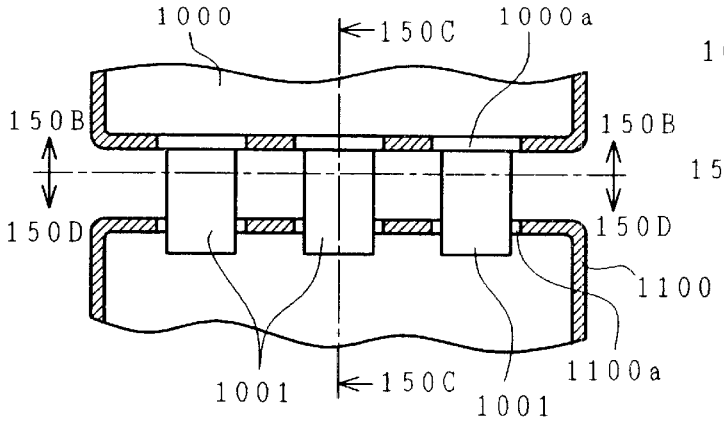
FIGS. 15A to 15D are illustrations of another type of an electrostatic quadrupole lens, FIG. 15A being a cross-sectional view of the electrostatic quadrupole lens of FIG. 15C taken along line 150A—150A, FIG. 15B being a cross-sectional view of the electrostatic quadrupole lens of FIG. 15A taken along line 150B—150B, FIG. 15C being a cross-sectional view of the electrostatic quadrupole lens of FIG. 15A taken along line 150C—150C and FIG. 15D being a cross-sectional view of the electrostatic quadrupole lens of FIG. 15A taken along line 150D—150D.
Figure 15C:
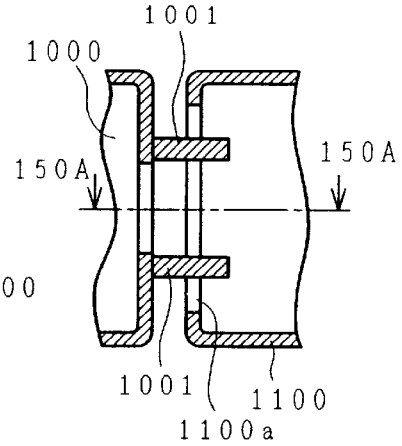
Figure 15B:
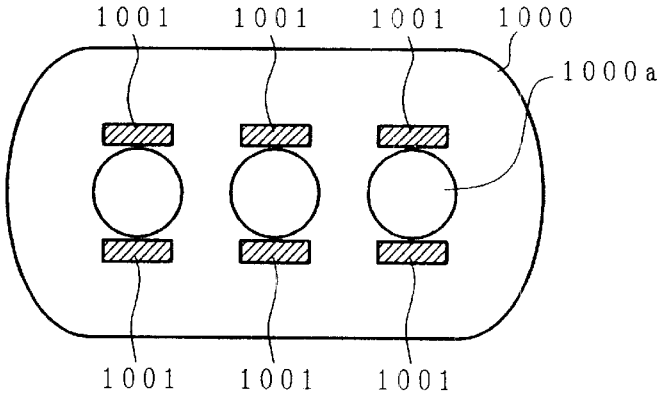
Figure 15D:
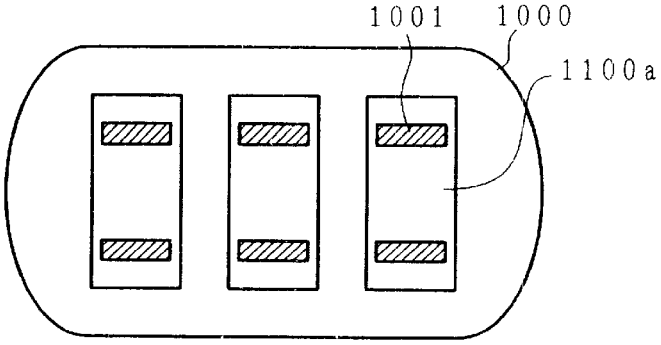

(5) As shown in FIGS. 15A to 15D, an quadrupole lens is formed by three vertically elongated rectangular apertures 1100*a* formed in an end face of one electrode 1100 of a pair of opposing electrodes 1000, 1100 and three pairs of horizontal plates 1001 each pair sandwiching a respective one of three electron beam paths, each pair extending into a respective one of the three rectangular apertures 1100*a* and attached to the other 1000 of the opposing electrodes 1000, 1100. FIG. 15A is a cross-sectional view taken at line 150A—150A in FIG. 15C, FIG. 15B is a cross-sectional view taken at line 150B—150B in FIG. 15A, FIG. 15C is a cross-sectional view taken at line 150C—150C in FIG. 15A and FIG. 15D is a cross-sectional view taken at line 150D—150D in FIG. 15A. Reference numeral 1100*a* denote circular apertures.

Figure 16A:
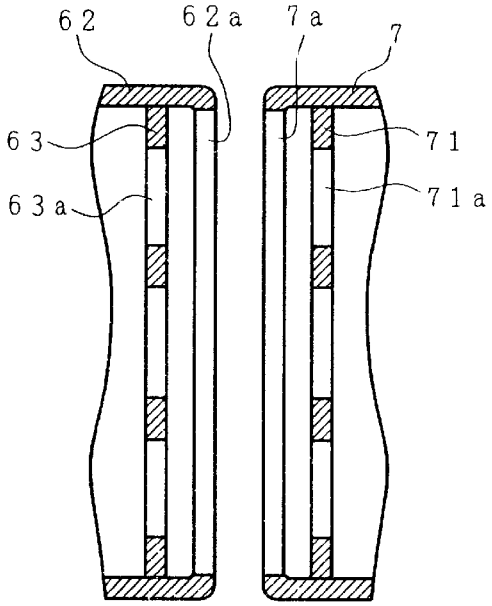
FIGS. 16A to 16C are illustrations of one type of a main lens, FIG. 16A being a cross-sectional view of the main lens, and FIGS. 16B and 16C being plan views of the facing portions of electrodes constituting the main lens, respectively.
Figure 16B:
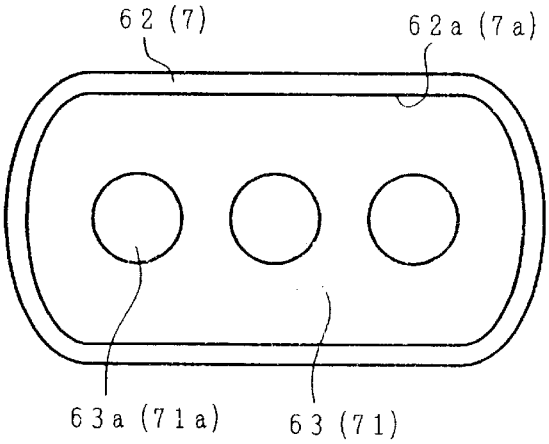
Figure 16C:
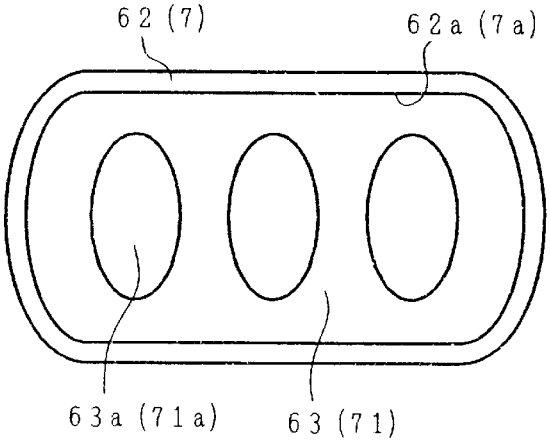
Figure 17:
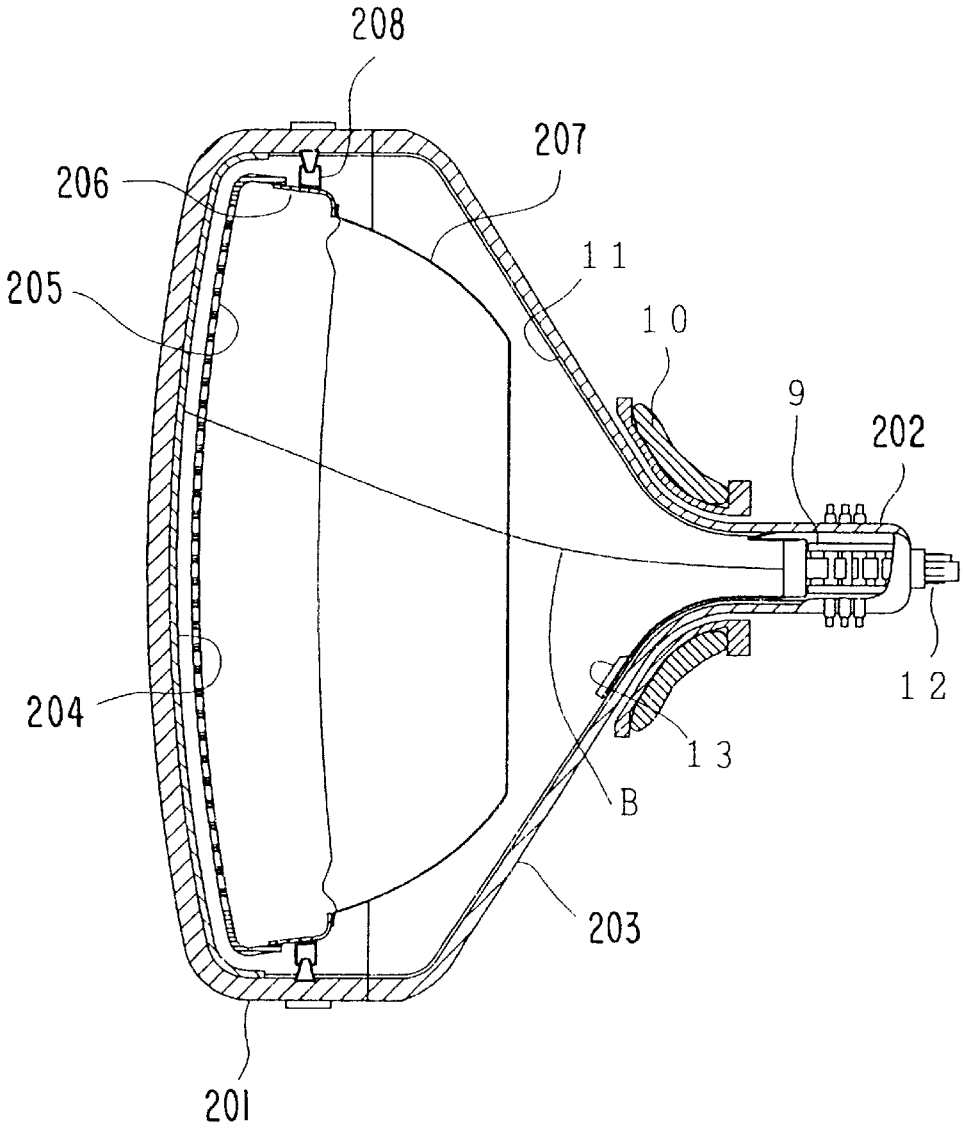
FIG. 17 (PRIOR ART)
FIG. 17 is across-sectional view of an example of a shadow mask type color cathode ray tube.

The second member 62 of the fifth electrode 6 and the anode 7 form a main lens, and they have single openings 62*a*, 7*a* in their respective opposing end faces, respectively, as shown in FIG. 16A. The second member 62 and the anode 7, respectively, may be provided with a plate electrode 63 (71) having three circular apertures 63*a* (71*a*) as shown in FIG. 16B, a plate electrode 63 (71) having three elliptical apertures 63*a* (71*a*) as shown in FIG. 16C or a plate electrode 63 (71) having three polygonal apertures.

As described above, according to the present invention, an electron beam-shaping electrostatic quadrupole lens is formed between the first member 41 and the second member 42 of the third electrode, and an electron lens is formed between the electron beam apertures 42*a* in the end face of the second member 42 on the first member 41 side thereof and the fourth electrode 5 adjacent to the second member 42 for diffusing the electron beams increasingly in the horizontal direction and for focusing the electron beams increasingly in the vertical direction with the increase in the difference between the voltage applied to the fourth electrode 5 and the second focus voltage applied to the second member 42. With this structure, the shaping strength of elongating the cross section of the electron beams horizontally can be increased to provide a sufficient amount of beam shaping such that a color cathode ray tube provides good and uniform focus over the entire viewing screen.

What is claimed is:

1. A color cathode ray tube comprising an evacuated envelope comprising a panel portion, a neck portion and a funnel portion for connecting said panel portion and said neck portion, a phosphor screen formed on an inner surface of said panel portion, an in-line type electron gun housed in said neck portion, and an electron beam deflection yoke mounted around said neck portion, said in-line type electron gun comprising an electron beam generating section having a plurality of in-line cathodes, a first electrode serving as an electron beam control electrode and a second electrode serving as an accelerating electrode arranged in the order named for projecting a plurality of electron beams arranged approximately in parallel with each other in a horizontal plane toward said phosphor screen, an electron beam focusing section comprising a third electrode, a fourth electrode, a fifth electrode and an anode arranged in the order named for focusing said plurality of electron beams on said phosphor screen, said third electrode comprising a first group of members and a second group of members, said fifth electrode comprising a first group of members and a second group of members of said fifth electrode, said first group of members of said third electrode and said first group of members of said fifth electrode being supplied with a first focus voltage of a fixed value, and said second group of members of said third electrode and said second group of members of said fifth electrode being supplied with a second focus voltage comprised of a fixed voltage and a dynamic voltage varying with deflection of said plurality of electron beams, wherein at least one first-type electrostatic quadrupole lens is formed between said first and second groups of members of said fifth electrode for increasingly focusing said plurality of electron beams in one of horizontal and vertical directions and for increasingly diffusing said plurality of electron beams in another of the horizontal and vertical directions with an increase in a focus voltage difference between said first focus voltage and said second focus voltage, at least one second-type electrostatic quadrupole lens is formed between said first and second groups of members of said third electrode for increasingly focusing said plurality of electron beams with the increase in the focus voltage difference in a direction perpendicular to said one of the horizontal and vertical directions in which one of said at least one first-type electrostatic quadrupole lens which is disposed nearest said anode increasingly focuses said plurality of electron beams with the increase in the focus voltage difference, and for increasingly diffusing said plurality of electron beams with the increase in the focus voltage difference in a direction perpendicular to said another of the horizontal and vertical directions in which said one of said at least one first-type electrostatic quadrupole lens which is disposed nearest said anode increasingly diffuses said plurality of electron beams with the increase in the focus voltage difference, and an electron lens is formed between said fourth electrode and a first aperture formed in a first surface of one member of said second group of said third electrode adjacent to said fourth electrode and forming another of said at least one second-type electrostatic quadrupole lens in combination with one member of said first group of said third electrode, said first surface of said one member of said second group of said third electrode being on a side of said one member of said second group of said third electrode opposite from said fourth electrode, said electron lens being configured so as to increasingly diffuse said plurality of electron beams in the horizontal direction with an increase in a voltage difference between said second focus voltage and a voltage applied to said fourth electrode and to increasingly focus said plurality of electron beams in the vertical direction with the increase in the voltage difference between said second focus voltage and the voltage applied to said fourth electrode.

2. A color cathode ray tube comprising an evacuated envelope comprising a panel portion, a neck portion and a funnel portion for connecting said panel portion and said neck portion, a phosphor screen formed on an inner surface of said panel portion, an in-line type electron gun housed in said neck portion, and an electron beam deflection yoke mounted around said neck portion, said in-line type electron gun comprising an electron beam generating section having three in-line cathodes, an electron beam control electrode and an accelerating electrode arranged in the order named for projecting three electron beams arranged approximately in parallel with each other in a horizontal plane toward said phosphor screen, an electron beam focusing section comprising a third electrode, a fourth electrode, a fifth electrode and an anode arranged in the order named for focusing the three electron beams on said phosphor screen, said third electrode comprising a first group of members and a second group of members of said third electrode, said fifth electrode comprising a first group of members and a second group of members of said fifth electrode, one member of said second group of members of said fifth electrode being disposed adjacently to said anode, said first group of members of said third electrode and said first group of members of said fifth electrode being supplied with a first focus voltage of a fixed value, and said second group of members of said third electrode and said second group of members of said fifth electrode being supplied with a second focus voltage comprised of a fixed voltage and a dynamic voltage varying with deflection of the three electron beams, wherein at least one first-type electrostatic quadrupole lens is formed between said first and second groups of members of said fifth electrode for increasingly focusing the three electron beams in one of horizontal and vertical directions and for increasingly diffusing the three electron beams in another of the horizontal and vertical directions with an increase in a focus voltage difference between said first focus voltage and said second focus voltage, at least one second-type electrostatic quadrupole lens is formed between said first and second groups of members of said third electrode for increasingly focusing the three electron beams with the increase in the focus voltage difference in a direction perpendicular to said one of the horizontal and vertical directions in which one of said at least one first-type electrostatic quadrupole lens which is disposed nearest said anode increasingly focuses the three electron beams with the increase in the focus voltage difference, and for increasingly diffusing the three electron beams with the increase in the focus voltage difference in a direction perpendicular to said another of the horizontal and vertical directions in which said one of said at least one first-type electrostatic quadrupole lens which is disposed nearest said anode increasingly diffuses the three electron beams with the increase in the focus voltage difference, and an electron lens is formed between said fourth electrode and an aperture formed in one member of said second group of said third electrode adjacent to said fourth electrode and forming another of said at least one second-type electrostatic quadrupole lens in combination with one member of said first group of said third electrode, said one member of said second group of said third electrode being a plate-like electrode and said aperture being a vertically elongated aperture, said electron lens being configured so as to increasingly diffuse the three electron beams in the horizontal direction with an increase in a voltage difference between said second focus voltage and a voltage applied to said fourth electrode and to increasingly focus the three electron beams in the vertical direction with the increase in the voltage difference between said second focus voltage and the voltage applied to said fourth electrode.

3. A color cathode ray tube according to claim 1 further comprising at least one electron lens formed between said first and second groups of members of said fifth electrode for focusing said plurality of electron beams in both the horizontal and vertical directions increasingly with the increase in the focus voltage difference.

4. A color cathode ray tube according to claim 2 further comprising at least one electron lens formed between said first and second groups of members of said fifth electrode for focusing said plurality of electron beams in both the horizontal and vertical directions increasingly with the increase in the focus voltage difference.

5. A color cathode ray tube according to claim 1, wherein said one member of said second group of said third electrode adjacent to said fourth electrode satisfies the following relationship:

$$L/D>1$$

where L is an axial distance between said first aperture and a second surface of said one member of said second group of said third electrode on a fourth electrode side thereof, and D is a diameter of a second aperture formed in said second surface.

6. A color cathode ray tube according to claim 1, wherein said one of said at least one first-type electrostatic quadrupole lens which is disposed nearest said anode increasingly focuses said plurality of electron beams in the vertical direction and increasingly diffuses said plurality of electron beams in the horizontal direction with the increase in the focus voltage difference.

7. A color cathode ray tube according to claim 5, wherein said one of said at least one first-type electrostatic quadrupole lens which is disposed nearest said anode increasingly focuses said plurality of electron beams in the vertical direction and increasingly diffuses said plurality of electron beams in the horizontal direction with the increase in the focus voltage difference.

8. A color cathode ray tube according to claim 3, wherein said one of said at least one first-type electrostatic quadrupole lens which is disposed nearest said anode increasingly focuses said plurality of electron beams in the vertical direction and increasingly diffuses said plurality of electron beams in the horizontal direction with the increase in the focus voltage difference.

9. A color cathode ray tube according to claim 2, wherein said one of said at least one first-type electrostatic quadrupole lens which is disposed nearest said anode increasingly focuses said plurality of electron beams in the vertical direction and increasingly diffuses said plurality of electron beams in the horizontal direction with the increase in the focus voltage difference.

10. A color cathode ray tube according to claim 4, wherein said one of said at least one first-type electrostatic quadrupole lens which is disposed nearest said anode increasingly focuses said plurality of electron beams in the vertical direction and increasingly diffuses said plurality of electron beams in the horizontal direction with the increase in the focus voltage difference.

11. A color cathode ray tube according to claim 5 further comprising at least one electron lens formed between said first and second groups of members of said fifth electrode for focusing said plurality of electron beams in both the horizontal and vertical directions increasingly with the increase in the focus voltage difference.

12. A color cathode ray tube according to claim 7, wherein the focus voltage difference between said first focus voltage and said second focus voltage decreases with increasing deflection of said plurality of electron beams.

13. A color cathode ray tube according to claim 11 wherein the focus voltage difference between said first focus voltage and said second focus voltage decreases with increasing deflection of said plurality of electron beams.

14. A color cathode ray tube according to claim 1, wherein the focus voltage difference between said first focus voltage and said second focus voltage decreases with increasing deflection of said plurality of electron beams.

15. A color cathode ray tube according to claim 3, wherein the focus voltage difference between said first focus voltage and said second focus voltage decreases with increasing deflection of said plurality of electron beams.

16. A color cathode ray tube according to claim 4, wherein the focus voltage difference between said first focus voltage and said second focus voltage decreases with increasing deflection of said plurality of electron beams.

17. A color cathode ray tube according to claim 9, wherein the focus voltage difference between said first focus voltage and said second focus voltage decreases with increasing deflection of said plurality of electron beams.

18. A color cathode ray tube according to claim 1, wherein the second focus voltage is higher than the voltage applied to said fourth electrode.

19. A color cathode ray tube according to claim 3, wherein the second focus voltage is higher than the voltage applied to said fourth electrode.

20. A color cathode ray tube according to claim 2, wherein the second focus voltage is higher than the voltage applied to said fourth electrode.

* * * * *